United States Patent [19]

Mullins

[11] 4,324,080

[45] Apr. 13, 1982

[54] THERMALLY INSULATIVE CEMENTITIOUS BLOCK MODULES AND METHOD OF MAKING SAME

[76] Inventor: Wayne L. Mullins, 5001 E. Cactus, Scottsdale, Ariz. 85254

[21] Appl. No.: 104,313

[22] Filed: Dec. 17, 1979

[51] Int. Cl.[3] ..... E04D 2/00

[52] U.S. Cl. ..... 52/309.12; 52/405; 52/425; 52/741

[58] Field of Search ..... 52/309.12, 405, 437, 52/440, 743, 606, 425, 426, 741

[56] References Cited

U.S. PATENT DOCUMENTS

| | | | |
|---|---|---|---|
| 2,172,052 | 9/1939 | Robbins | 52/405 |
| 3,221,457 | 12/1965 | Vevoda | 52/425 X |
| 3,416,276 | 12/1968 | Caputo et al. | 52/606 X |
| 3,817,013 | 6/1974 | Selby | 52/437 |
| 4,015,387 | 4/1977 | Tillie | 52/405 X |
| 4,185,434 | 1/1980 | Jones | 52/405 |

*Primary Examiner*—Price C. Faw, Jr.
*Assistant Examiner*—Carl D. Friedman
*Attorney, Agent, or Firm*—Herbert E. Haynes, Jr.

[57] ABSTRACT

A plurality of especially configured cementitious blocks arranged in a modular array with at least one planar polyurethane foam panel cast and cured in situ within the blocks to fusingly bond the blocks together and provide the modular array with an integral coextensive uninterrupted thermally insulative barrier.

16 Claims, 16 Drawing Figures

FIG. 9
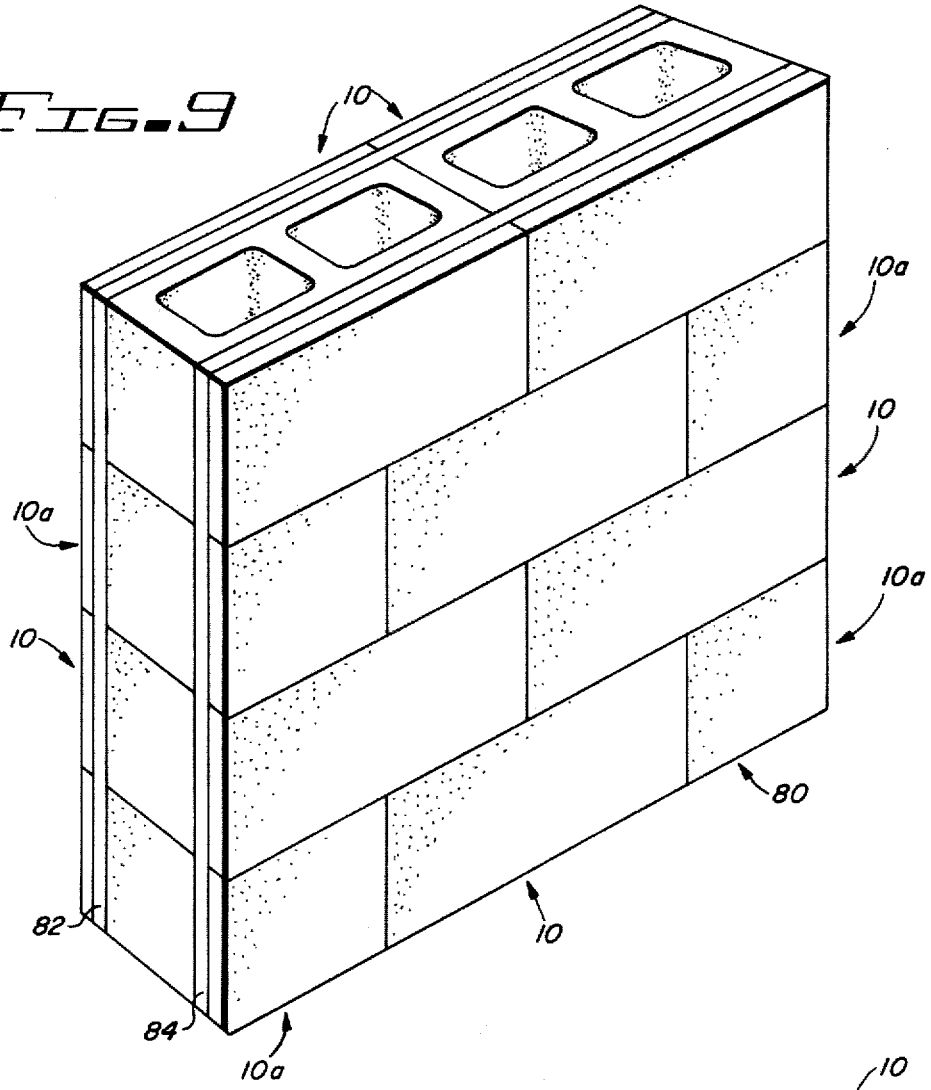
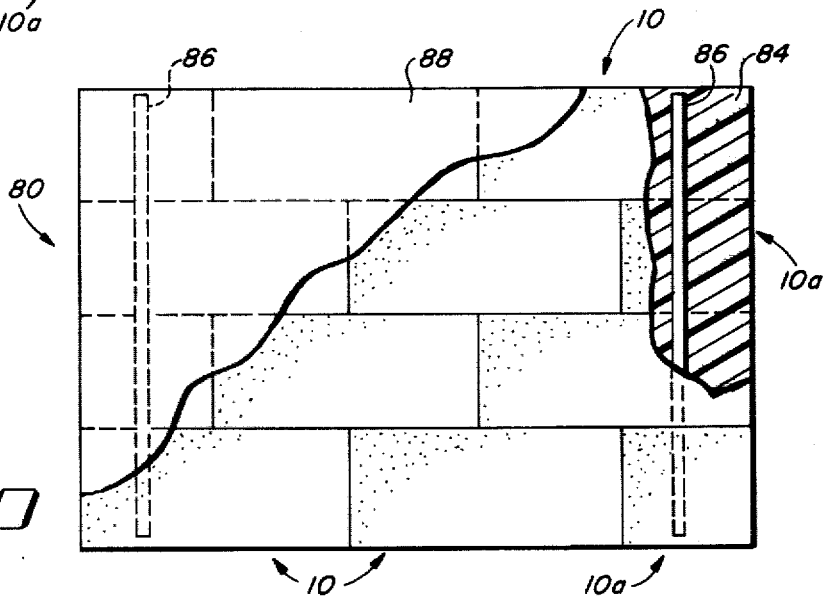
FIG. 10

FIG. 15
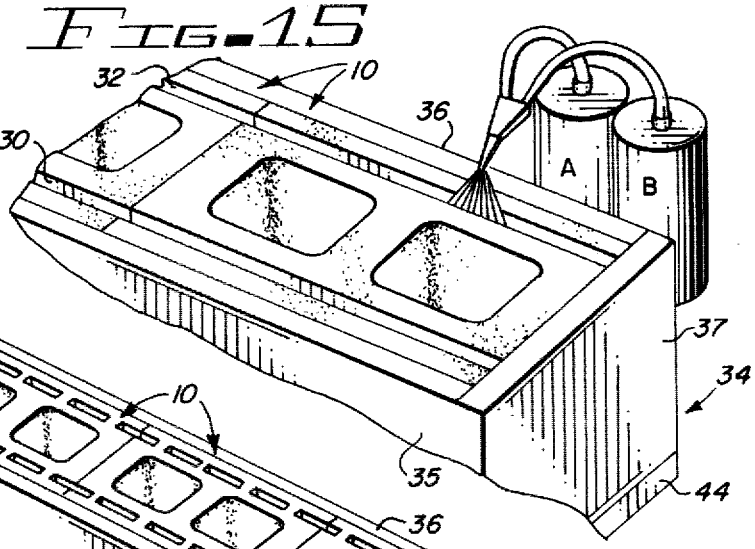
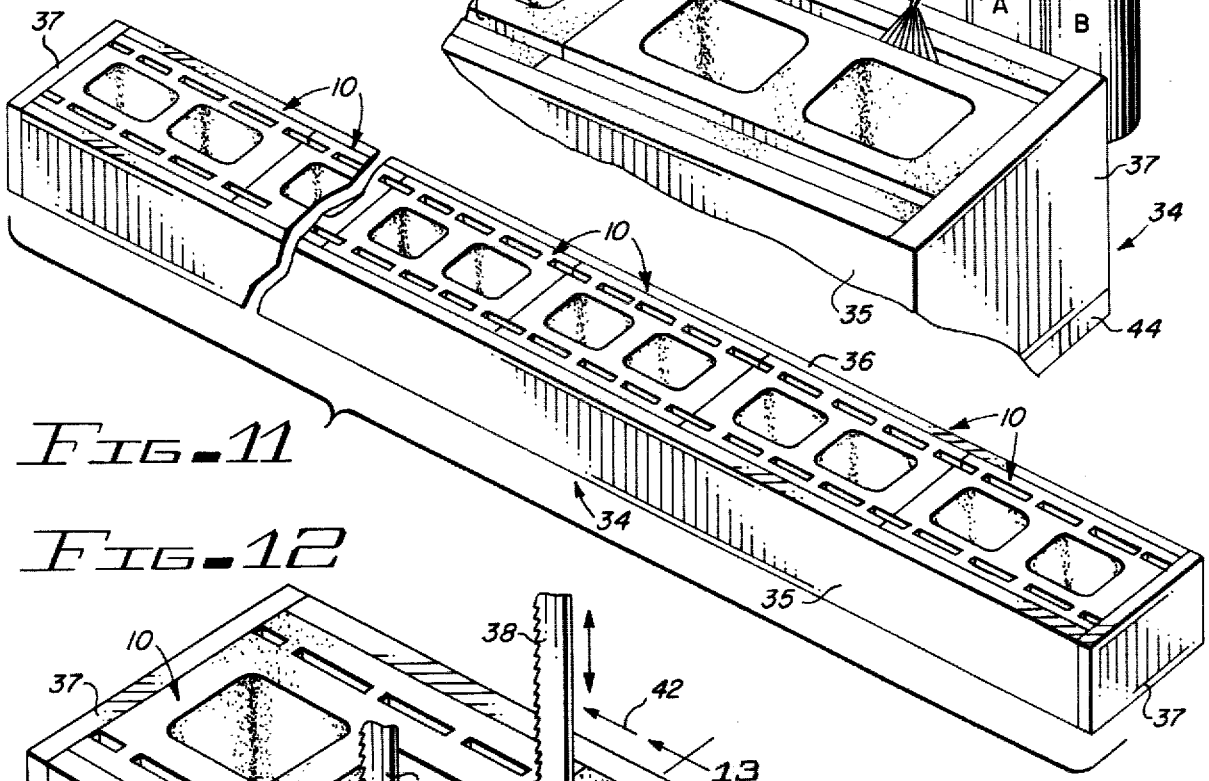
FIG. 11
FIG. 12
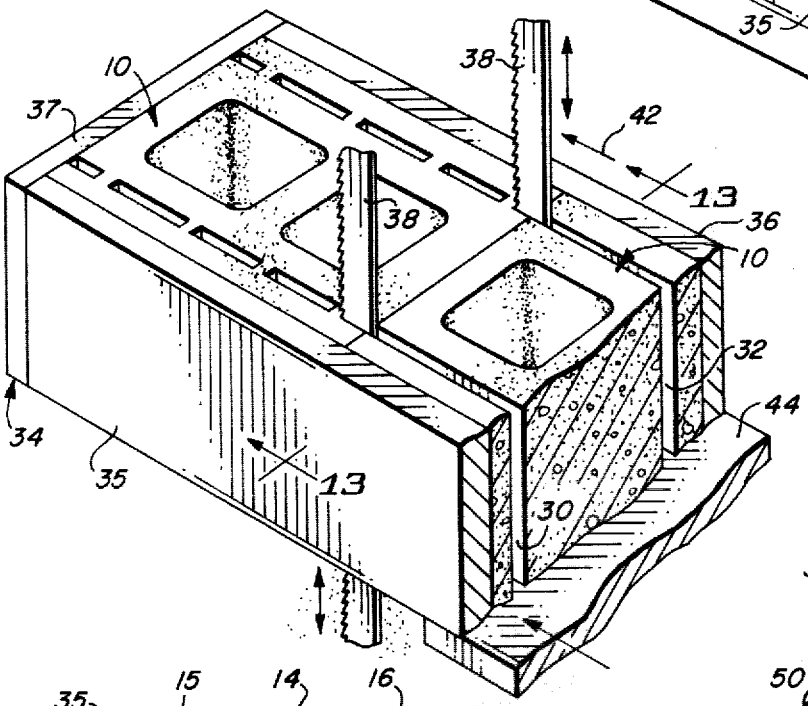
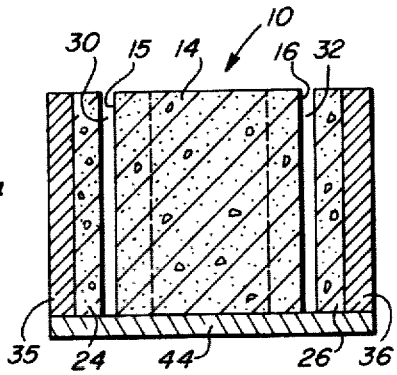
FIG. 13
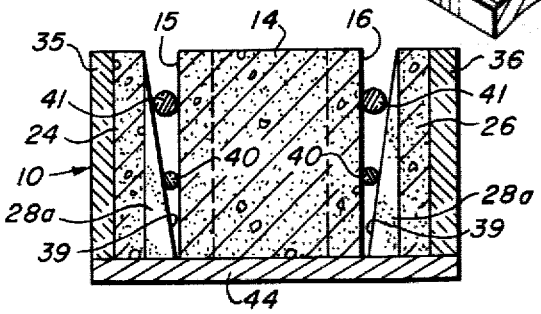
FIG. 14
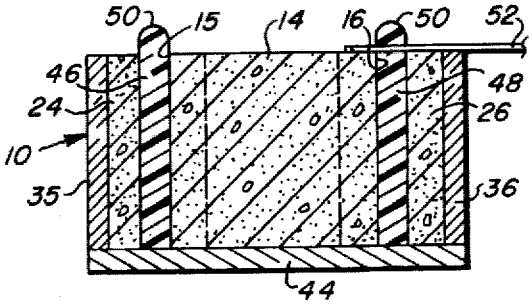
FIG. 16

THERMALLY INSULATIVE CEMENTITIOUS BLOCK MODULES AND METHOD OF MAKING SAME

BACKGROUND OF THE INVENTION

1. Field of the Invention

This invention relates to the construction arts and more particularly to cementitious block modules having uninterrupted coextensive thermally insulative panels integrally formed therein.

2. Description of the Prior Art

Cementitious blocks have long been used for wall construction in the building trades and the technique commonly used is to set the cementitious blocks one at a time in rows atop a suitable footing, with mortar being employed to interconnect the adjacent blocks. This commonly used technique requires considerable skill to achieve the desired alignment of the blocks, acceptable block laying speeds, consistent and sufficient amounts of mortar, and the like. The relatively high degree of skill has resulted in block laying becoming a highly paid craft, and this along with many other factors such as material costs, financing rates, and the like has significantly contributed to the very high, and in many cases, prohibitive expense of buying homes, small commercial buildings and the like.

In addition to the cost factor, cementitious blocks are notoriously poor from a thermally insulative standpoint, and several techniques are being employed in attempts to improve this situation. For example, the inner surface of a cementitious block wall has, for many years been covered with plasterboard, or other paneling materials which are attached to the walls in spaced relationship, with this technique being commonly referred to as "furring-out". Until recently, the space between the blocks and the furred-out panels has been left empty. Now, however, this space is commonly filled with a suitable thermal insulative material. Such space is however, relatively small, usually not more than one inch, and the benefits resulting from insulating this space are also relatively small, and the expense of increasing the size of that space is prohibitive. Another technique in common usage is to fill the vertically extending cores or passages of the block wall with insulative material, and again the benefits are relatively small due to the fact that the end walls and center rib wall of each cement block are not insulated and will therefore readily pass thermal energy. Still another technique, which is not receiving a great deal of acceptance due to the expense, is to instal siding on the exterior surface of the block wall.

In view of the above, a need exists for new and useful cementitious block modules with coextensive uninterrupted thermally insulative panels formed integrally therein, with such modules overcoming some of the problems and shortcomings of the prior art.

SUMMARY OF THE INVENTION

In accordance with the present invention, new and useful cementitious block modules having uninterrupted coextensive thermally insulative panels of polyurethane foam integrally formed therein and a method of making same are disclosed.

Cementitious blocks of special configuration are employed, with each block having a central body portion located between a pair of face panels which are spaced from and coextensive with the opposite longitudinal surfaces of the central body portion. The opposite face panels are connected to the central body by thin webs, with the spaces between the central body portion and the opposite face panels extending the full length and height of the block.

The especially cast cementitious blocks of the above described type are aligningly arranged in an assembly plant facility to form a desired modular configuration, and the chemical constituents which form polyurethane foam are placed in the spaces between the central body and the face panels of the blocks. During curing, the chemical constituents will expand and completely fill the aligned spaces between the central bodies and the face panels of the plurality of blocks. During curing, the chemical constituents will expand and completely fill the aligned spaces and form a spaced pair of coextensive uninterrupted thermally insulative panels. As is well known, polyurethane foam has excellent thermal insulative characteristics and thus the pair of uninterrupted coextensive polyurethane foam panels provides the block module of the present invention with excellent thermally insulative characteristics. Another characteristic of the polyurethane foam is that upon curing it will form a tenacious bond with many materials and cement is among the best of such materials. Therefore, after curing, the face panels are fusingly bonded to their respective polyurethane foam panels which are in turn fusingly bonded to the opposite sides of the central body portions of the cementitious blocks.

In some instances, such as in non-load-bearing walls, the uninterrupted coextensive polyurethane foam panels will be sufficient to hold the plurality of blocks in the desired modular array. In other locations which require additional structural strength, several techniques may be employed. For example, the individual cementitious blocks may be interconnected by a suitable adhesive mortar such as epoxy, and/or one or both of the planar faces of the completed block module may be coated with a suitable surface bonding cement, and/or reinforcing bars may be inserted in the spaces between the central body portions and the face panels of the aligned cementitious blocks prior to placement and curing of the polyurethane foam therein.

In any event, the cementitious block modules with the coextensive integral and uninterrupted thermally insulative panels therein may be aligningly arranged in various arrays such as a plurality of the especially configured cementitious blocks disposed in an end to end relationship to form an elongated row configuration. The blocks may be stacked to form a columnar configuration, or they may be arranged in both columns and rows to form a modular configuration of either rectangular or square shape.

From the above, it will be appreciated that the thermally insulative cementitious block modules of the present invention will save considerable labor costs in that a plurality of cementitious blocks are laid at once rather than the prior art technique of laying one at a time. Further, the end result is a cementitious block wall having excellent thermal insulative properties.

Accordingly, it is an object of the present invention to provide new and useful cementitious block modules.

Another object of the present invention is to provide a method of making new and improved cementitious block modules.

Another object of the present invention is to provide new and useful cementitious block modules which are prefabricated and include at least one coextensive uninterrupted thermally insulative polyurethane foam panel which is integrally formed therein.

Another object of the present invention is to provide new and useful cementitious block modules which include a plurality of cementitious blocks aligningly arranged in a desired modular array with at least one uninterrupted thermally insulative polyurethane foam panel integrally formed therein so as to be coextensive with the planar surface of the modular array.

Another object of the present invention is to provide new and useful cementitious block modules of the above described character in which the polyurethane foam panel is cast and cured in situ within the plurality of cementitious blocks so that upon curing, the plurality of cementitious blocks will be fusingly bonded into the desired modular array by the uninterrupted coextensive polyurethane foam panel.

Another object of the present invention is to provide new and useful cementitious block modules of the above described character wherein the plurality of cementitious blocks are arranged in an end to end relationship to form an elongated row modular array.

Another object of the present invention is to provide new and useful cementitious block modules of the above described type wherein the plurality of cementitious blocks are arranged in stacked vertical relationship to form an elongated columnar modular array.

Another object of the present invention is to provide new and useful cementitious block modules of the above described character in which the plurality of cementitious blocks are arranged in both stacked and end to end relationships to form a planar modular array of multiple columns and rows.

Another object of the present invention is to provide new and useful cementitious block modules of the above described types wherein the plurality of cementitious blocks are further bonded into the desired modular array by adhesive mortar interposed between the abutting surfaces of the adjacent blocks.

Another object of the present invention is to provide new and useful cementitious block modules of the above described character wherein the plurality of cementitious blocks are further bonded into the desired modular arrays by a coating of surface bonding cement which is applied to at least one of the planar surfaces of the modular array.

Still another object of the present invention is to provide new and useful cementitious block modules wherein each of the plurality of cementitious blocks are formed with a central body portion with at least one face panel coextensive and spaced from one of the longitudinal surfaces of the central body portion, with that space serving to receivingly contain the polyurethane foam panel.

Yet another object of the present invention is to provide new and useful cementitious block modules of the above described character in which the modular arrays may be further bonded into the desired modular arrays by placement of reinforcing bars within the aligned spaces between the central body portions and the face panels of the blocks prior to casting and curing of the polyurethane foam panel therein.

The foregoing and other objects of the present invention, as well as the invention itself, may be more fully understood from the following description when read in conjunction with the accompanying drawings.

BRIEF DESCRIPTION OF THE DRAWINGS

FIG. 9 is a perspective view of a third embodiment of the thermally insulative cementitious block modules of the present invention.

FIG. 10 is an elevational view of the module shown in FIG. 9 and illustrating additional ways in which the plurality of cementitious blocks may be bonded together to form the module.

FIG. 11 is a perspective view which illustrates a first step in the method of the present invention wherein a plurality of previously cast and cured especially configured cementitious blocks are arranged in the desired modular array within a special holding fixture.

FIG. 12 is an enlarged fragmentary perspective view similar to FIG. 11 and illustrating a second step in the method of the present invention.

FIG. 13 is an enlarged sectional view taken along the line 13—13 of FIG. 12 and illustrating the results of the step of FIG. 12.

FIG. 14 is an enlarged sectional view similar to FIG. 13 and illustrating an alternate result of the step of FIG. 12.

FIG. 15 is a fragmentary perspective view similar to FIG. 11 and illustrating another step in the method of the present invention.

FIG. 16 is an enlarged sectional view similar to FIGS. 13 and 14 and illustrating still another step in the method of the present invention.

DESCRIPTION OF THE PREFERRED EMBODIMENTS

Figure 1:
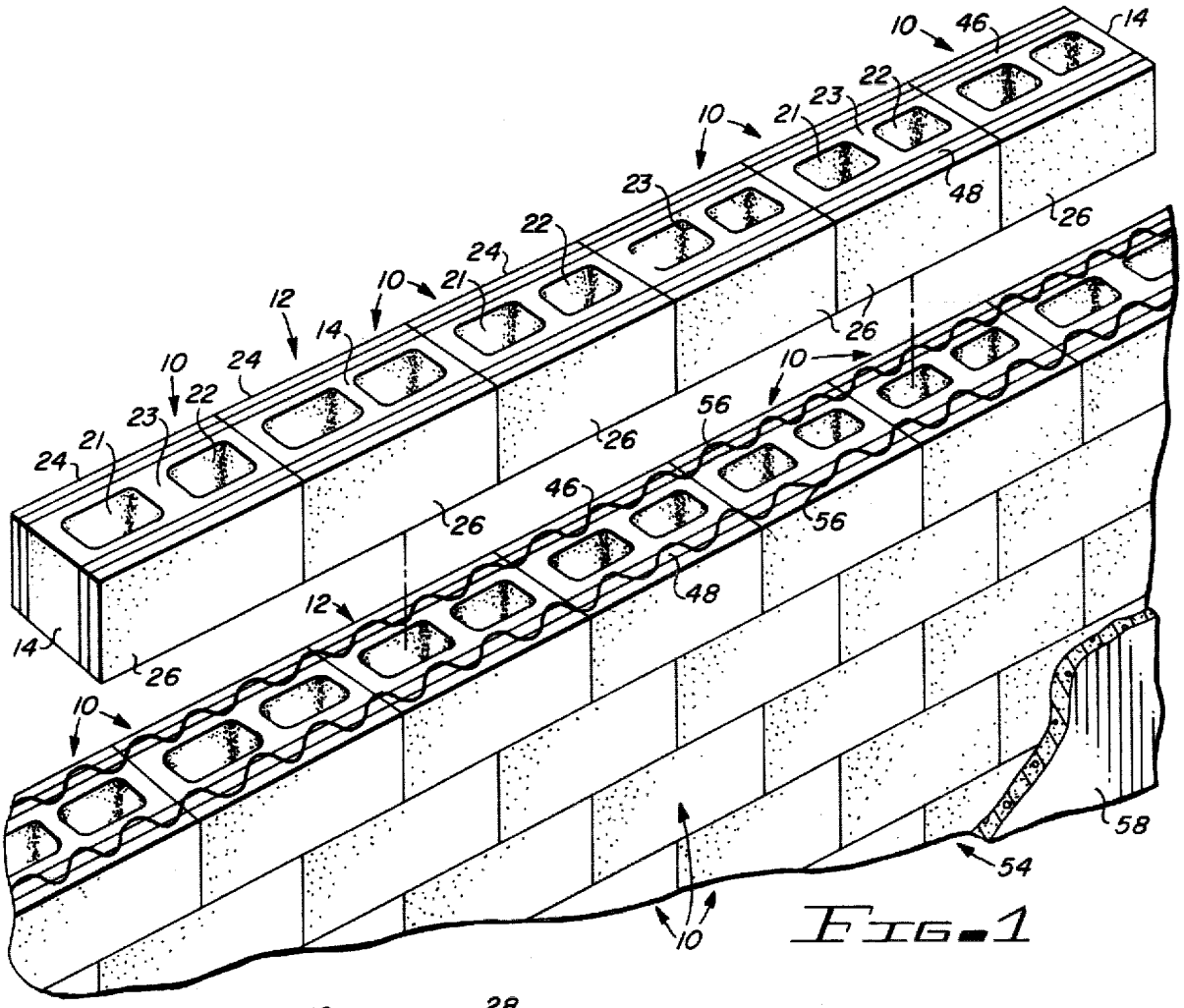
FIG. 1 is a fragmentary perspective view of a building wall formed of a plurality of a first embodiment of the thermally insulative cementitious block modules of the present invention, with one of those modules being illustrated in an exploded relationship.

Referring more particularly to the drawings, FIG. 1 illustrates a plurality of cementitious blocks 10 which are arranged and fusingly bonded into a first embodiment of the thermally insulative cementitious block modules of the present invention, with this particular modular array being identified in its entirety by the reference numeral 12.

Figure 2:
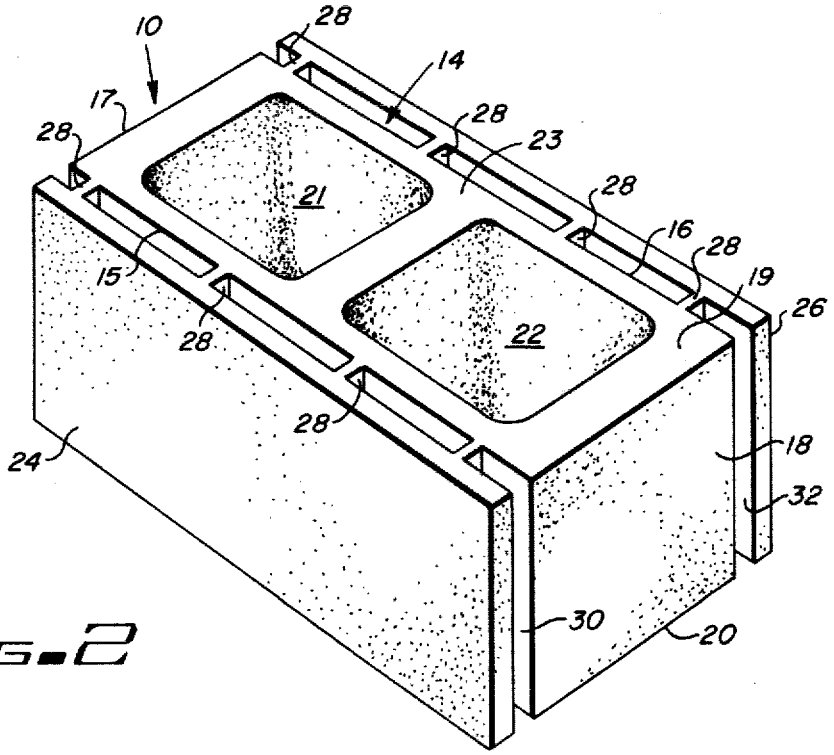
FIG. 2 is a perspective view of a typical one of the especially configured cementitious blocks employed in forming the thermally insulative cementitious block modules of the present invention, with the block being illustrated as it would appear prior to being arranged in the desired modular array and prior to the casting and curing of the polyurethane foam panel therein.
Figure 3:
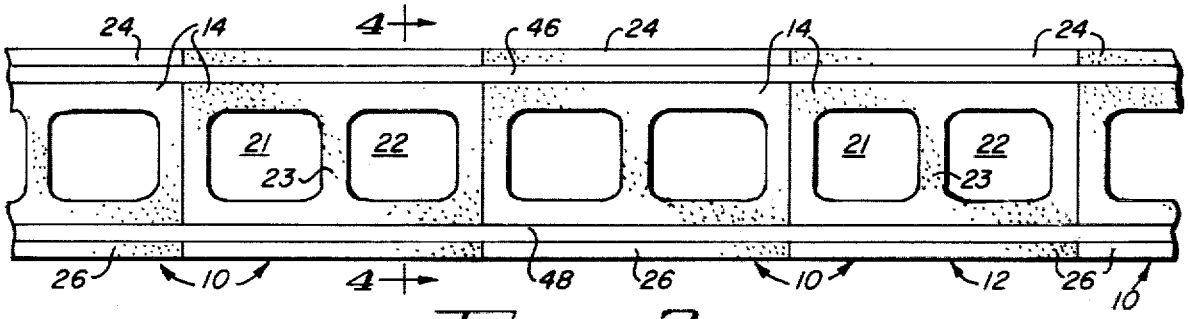
FIG. 3 is an enlarged fragmentary plan view of one of the thermally insulative cementitious block modules shown in FIG. 1.
Figure 4:
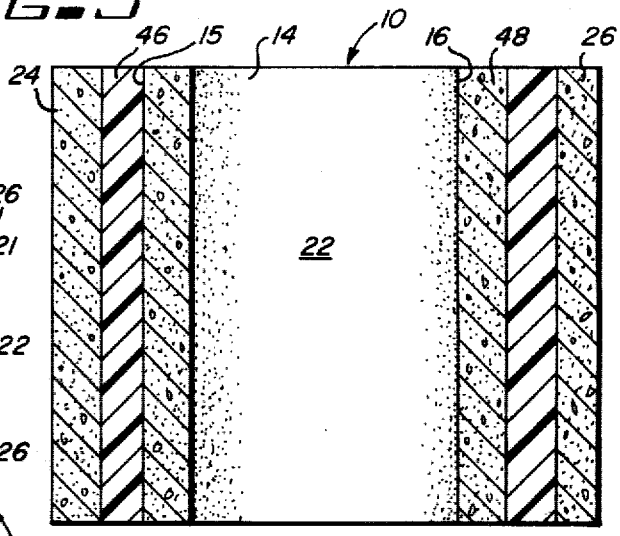
FIG. 4 is an enlarged sectional view taken on the line 4—4 of FIG. 3.

Prior to describing the physical characteristics and method of making the modular array 12, it is deemed advisable to fully describe the special configuration of the cementitious blocks 10 employed, and a typical one of such blocks 10 is illustrated in FIG. 2.

As shown, the cementitious block 10 includes a central body portion 14 having an opposed pair of longitudinally extending planar surfaces 15 and 16, an opposed pair of planar end surfaces 17 and 18, top surface 19 and bottom surface 20, with a pair of vertical passages 21 and 22 that are separated by a center rib wall 23. The cementitious block 10 further includes a pair of planar face panels 24 and 26 which are each spaced from and coextensive with respect to different ones of the longitudinal planar surfaces 15 and 16 of the central body portion 14 thereof. The face panels 24 and 26 are spaced from and integrally connected to their respective opposite surfaces 15 and 16 of the central body portion 14 by a plurality of thin webs 28 which extend normally therebetween. Thus, the particular configuration of the central body portion 14 and the planar face panels 24 and 26 with the interconnecting webs 28 define a first passage 30 formed within and proximate one longitudinal side of the block 10 so as to extend substantially the full height and length of the block, and a second passage 32 similarly disposed and configured in the opposite longitudinal side of the block.

In accordance with the method of the present invention, the thermally insulative block module 12 is formed by first placing a plurality of the especially configured cementitious blocks 10 which have previously been cast and cured in the configuration previously described, in an aligned end to end position within a suitable holding fixture 34 as shown in FIG. 11. The fixture 34 includes a spaced pair of longitudinally extending side walls 35 and 36 and a pair of opposite end closing walls 37, all of which are positioned to be in contiguous engagement with the appropriate surfaces of the cementitious blocks 10 to hold them in the desired aligned position.

The next step, as illustrated in FIG. 12, is to pass a suitable cement cutting tool 38, such as the illustrated band saw blades, through the aligned passages 30 and 32 of the plurality of blocks to either partially or completely remove the webs 28 as will hereinafter be described in detail. Removal of the webs 28 is not a mandatory step, however, it is highly desirable in that leaving the webs in place would provide the completed block module 12 with a plurality of conductive paths by which thermal energy will readily pass through the module. It will now be seen that the webs 28 are provided in the blocks 10 only for the purpose of positioning the planar face panels 24 and 26 relative to the central body portion 14 and temporarily holding them in that position until such time as that function can be taken over by the polyurethane foam panels as will hereinafter be described in detail.

For reasons which will hereinafter be described, the webs 28 (FIG. 2) located in the aligned passages 30 and 32 of the plural blocks 10 of the module 12 may be completely removed as shown in FIG. 13. Otherwise, the webs 28 can be partially removed as shown in FIG. 14 with such partial removal severing the connections between the face panels 24 and 26 and the central body portion 14 and providing the remaining web portions **28*a* with angularly downwardly sloping surfaces 39 for supporting longitudinally extending reinforcing rods 40 and 41. As seen, the reinforcing rods 40 have cross sectional diameters which allow them to drop farther down in the passages 30 and 32 than the reinforcing rods 41** which have larger cross sectional diameters.

As the cement cutting tool 38 moves through the passages 30 and 32 in the direction of the arrow 42, it is immediately followed by a fixture bottom closing panel 44 for supporting the block 10 and closing the bottoms of the passages 30 and 32.

The next step of the present method is to place the chemically reacting constituents which form polyurethane foam in both of the aligned passages 30 and 32 of the plurality of blocks 10, with such placement being accomplished in any suitable manner such as by employing the equipment shown in FIG. 15. The chemical constituents will react with each other in the well known manner commonly referred to as polymerization. The reacting chemical constituents expand very rapidly during polymerization and the resulting polyurethane foam will have a mass which is many times that of the chemical constituents. Thus, the polyurethane foam will completely fill the aligned passages 30 and 32 of the plural blocks 10 which make up the block module 12, and the module is, as shown best in FIG. 1, thereby provided with uninterrupted polyurethane foam panels 46 and 48 which provide the module 12 with thermally insulative barriers. In addition to the well known thermal insulative properties of polyurethane foam, another characteristic of this particular material is necessary in the fabrication of the block module 12. This characteristic is that when polyurethane foam is cast and cured (polymerized) in contiguous engagement with various other materials, it will form a tenacious bond with those materials and cement is among the best of those materials. Therefore, the casting and curing of the polyurethane foam panels 46 and 48 in situ within the aligned passages 30 and 32 will fusingly bond the multiple face panels 24 and 26 to the polyurethane foam panels 46 and 48 respectively, and the foam panels will in turn be fusingly bonded to the opposite longitudinal surfaces 15 and 16 of the central body portions 14 of the plural blocks 10.

As hereinbefore mentioned, during polymerization of the polyurethane foam, rapid expansion thereof occurs. It will be noted that no closure is provided on the top of the fixture 34 which allows the expanding polyurethane foam to completely fill the passages 30 and 32 and yet allows it to be free to expand up above the open tops of those passages. This eliminates the possibility of excessive pressure cracking or otherwise damaging the blocks 10 and/or the fixture 34. After polymerization is complete, the polyurethane foam will protrude from the open tops of the passages 30 and 32 as shown at 50 in FIG. 16. The final step in the present process, other than removing the completed module from the fixture 34, is to trim off the protruding polyurethane foam such as with a suitable knife 52.

As hereinbefore described, the ribs 28 may be completely removed from the passages 30 and 32 of the blocks 10 which make up the block module 12. In this case, the module will be held together by the polyurethane foam panels 46 and 48, and such modules are suitable for use in the fabrication of, for example, non-load-bearing walls. Increasing the structural strength of the modules may be accomplished in various ways. First, a suitable adhesive mortar (not shown) may be placed between the abutting surfaces of the blocks 10 prior to placement thereof within the fixture 34. The adhesive mortar may, for example, be any two component epoxy adhesive and a particular product suitable for such use is manufactured by the Thermoset Plastics Corporation, 5101 East 65th Street, Indianapolis, Indiana—46220, and the product is identified as "Thermoset 428 Epoxy Mortar".

Figure 5:
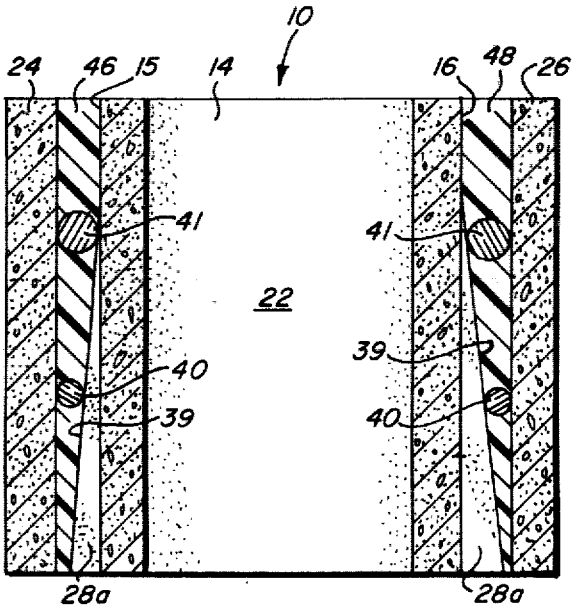
FIG. 5 is a sectional view similar to FIG. 4 and showing an additional way in which the plurality of cementitious blocks are bonded together to form the modular array.

When the partial ribs 28*a*, as seen in FIGS. 5 and 14 are left in the passages 30 and 32 as hereinbefore described, the reinforcing rods 40 and 41 may be placed in the passages. Thus, when the polyurethane foam panels 46 and 48 are cast and cured in situ within the passages, the rods 40 and 41 will be firmly anchored in place.

The plurality of cementitious block modules 12 are assembled, or laid, in a more or less conventional manner as shown in FIG. 1, in which each module 12 forms all or part of a horizontally extending row, and the rows cooperate to form the block wall 54. The abutting surfaces of the adjacent of the block modules 12 are bonded together such as by a suitable adhesive mortar 56 of the type previously described.

When the wall 54 is completed, additional structural strength may be provided by applying a surface bonding cement on one, or both of the opposite planar surfaces thereof to provide a surface bonding cement coating 58. Surface bonding cement is a well known Portland cement and glass fiber mixture which is used in the construction of concrete block walls in lieu of mortar. A particular surface bonding cement suitable for this purpose is available from the Q-Bond Corporation of America, P.O. Box 699, Fort Collins, Colorado—80522, and is identified as "Q-Bond". Another surface bonding cement suitable for this purpose is available from the W. R. Bonsel Company, P.O. Box 38, Lilesville, North Carolina—28091, and is identified as "Surewall".

Figure 6:
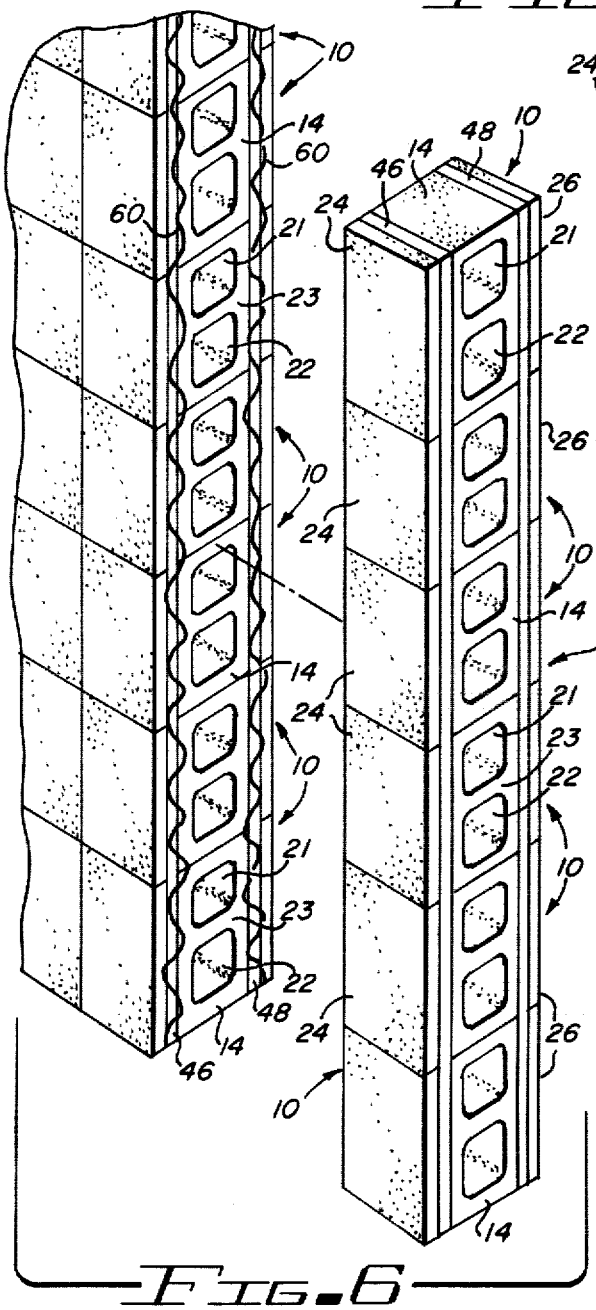
FIG. 6 is a fragmentary perspective view illustrating an alternate erection technique by which a building wall may be formed by the first embodiment of the thermally insulative cementitious block modules of the present invention.

An alternate way of using the cementitious block modules 12 is illustrated in FIG. 6 wherein modules are stood on end so that each module will form a complete, or part of, a vertical column. The plural columns are fixedly connected to each other by interposing adhesive mortar 60 between the abutting surfaces.

Figure 7:
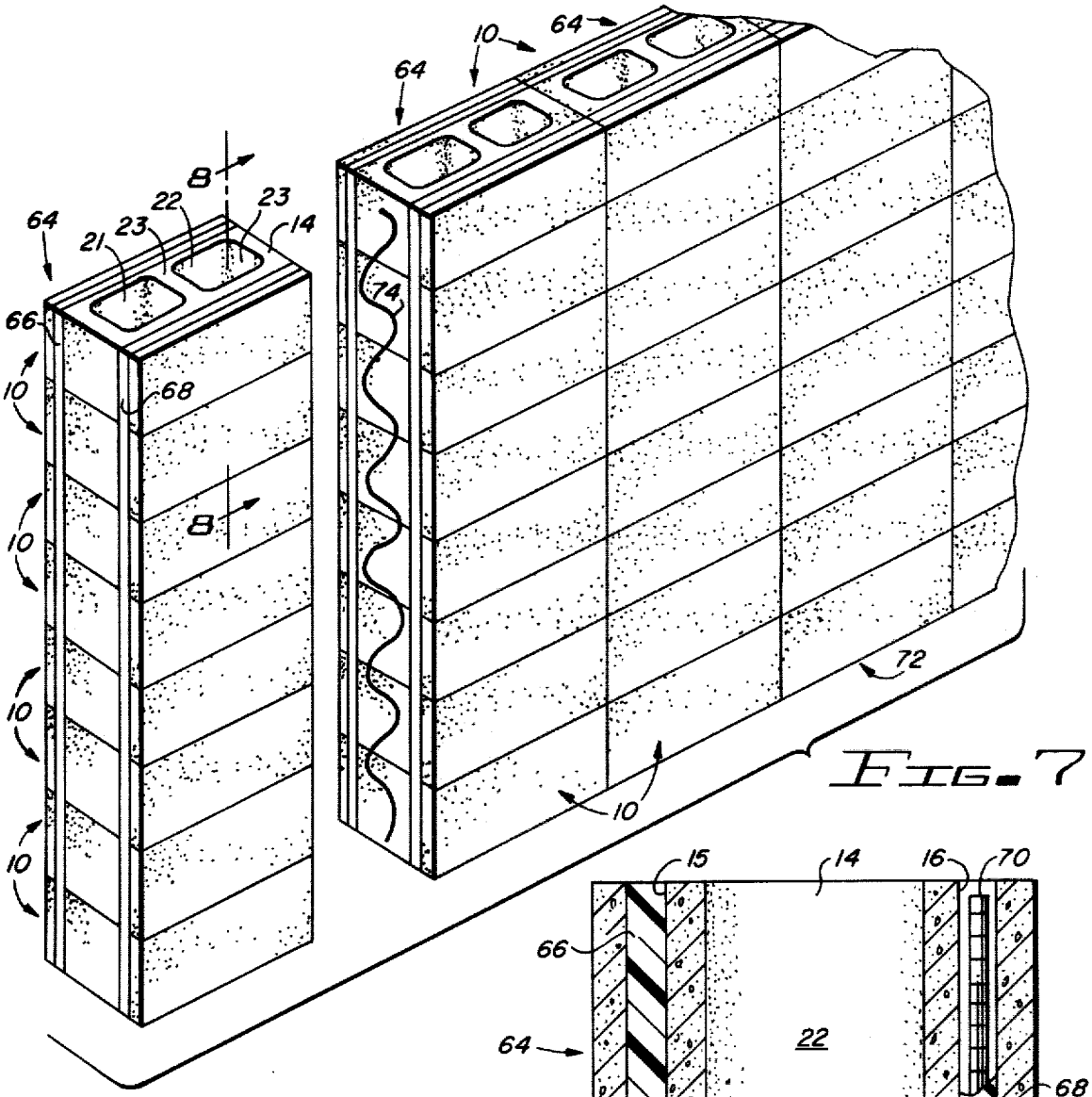
FIG. 7 is a fragmentary perspective view of a building wall formed of a plurality of a second embodiment of the thermally insulative cementitious block modules of the present invention with one of those modules being illustrated in exploded relationship thereto.
Figure 8:
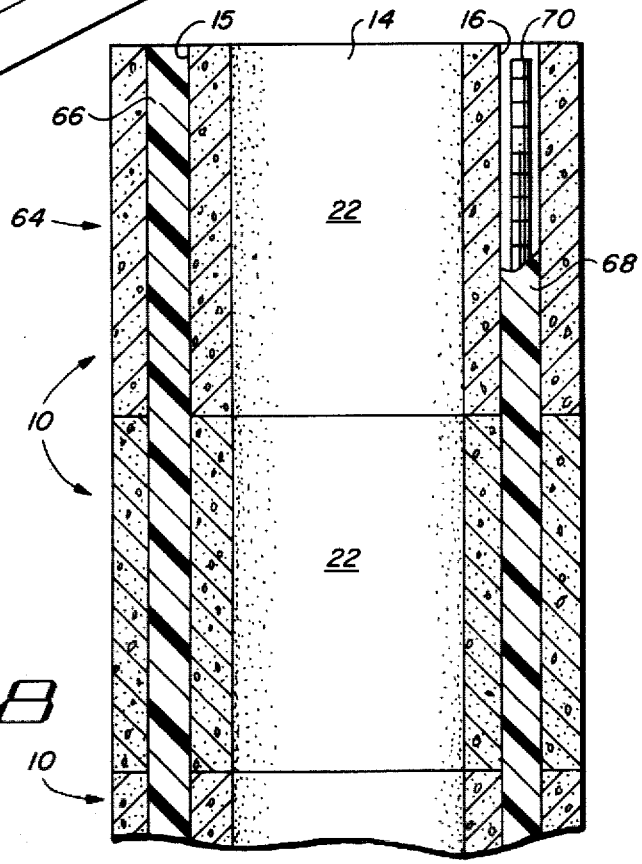
FIG. 8 is an enlarged fragmentary sectional view taken along the line 8—8 of FIG. 7.

FIGS. 7 and 8 illustrate another block module configuration which is indicated generally by the reference numeral 64, and which forms a second embodiment of the present invention. The block module 64 includes a plurality of the previously described cementitious blocks 10 which are stacked on top of each other to form a vertical columnar configuration which may incorporate any of the previously described structural rigidification means. In this arrangement, the vertical passages 21 and 22 formed through each of the blocks 10 are in alignment with each other so that the module 64 has two vertical passages extending completely therethrough. The passages 30 and 32 (FIG. 2) of each block 10 are in vertical alignment with each other, and the coextensive uninterrupted polyurethane foam panels 66 and 68 are cast and cured in situ therein in accordance with the method previously described. In this particular configuration, the ribs 28 (FIG. 2) are preferably completely removed, and reinforcing rods 70 (one shown) may be placed at desired intervals so as to extend vertically through one, or both, of the vertical passages formed by the aligned passages 30 and 32 of the plurality of blocks 10.

The cementitious block modules 64 are employed to form the block wall 72 by utilizing the adhesive mortar 74 on the abutting surfaces of the modules.

FIGS. 9 and 10 show still another cementitious block module configuration which is indicated generally by the reference numeral 80, and which forms a third embodiment of the present invention. The block module 64 includes a plurality of the previously described cementitious blocks 10 which are stacked in both columns and rows to form a planar configuration of either square or rectangular shape. The blocks may be stacked in a conventional laterally offset arrangement as shown, in which case the half blocks 10*a* will be used, with the half blocks being formed similar to the blocks 10. Alternately, the module 80 may include the use of blocks 10 only in which case (not shown) the blocks are arranged in vertical alignment. In any case, the module 80 includes the coextensive and uninterrupted polyurethane foam panels 82 and 84, and may incorporate any or all of the hereinbefore described structural reinforcing means, such as the vertically disposed reinforcing rods 86 (one shown) and the surface bonding cement coating 88.

While the principles of the invention have now been made clear in illustrated embodiments, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A thermally insulative cementitious block module comprising:

(a) a plurality of cementitious blocks arranged in an aligned desired modular array so that each of said blocks is in abutting engagement with at least another one of said blocks, each of said blocks defining at least one passage which extends the full length and height thereof, said passages of said plurality of blocks being in alignment with each other; and (b) a polyurethane foam panel cast and cured in situ within said aligned passages of said plurality of blocks to provide said modular array with a one piece uninterrupted coextensive thermally insulative barrier which fusingly bonds said plurality of blocks into said modular array.

2. A thermally insulative cementitious block module comprising:

(a) a plurality of cementitious blocks each including,

I. a central body portion having an opposed pair of longitudinal surfaces, and

II. a face panel in spaced coextending relationship with one of the longitudinal surfaces of said central body portion to define a coextensive passage between that longitudinal surface of said central body portion and said face panel;

(b) said plurality of cementitious blocks arranged in a modular array so that each of said blocks is in abutting engagement with at least another one of said blocks, said plurality of cementitious blocks aligned with respect to each other so that the passages defined in each of said blocks are in alignment; and (c) a polyurethane foam panel cast and cured in situ within the aligned passages defined by said plurality of cementitious blocks to fusingly bond said blocks into the modular array and form a one piece uninterrupted integral thermally insulative barrier which is coextensive with the modular array.

3. A thermally insulative cementitious block module as claimed in claim 2 and further comprising:

(a) said plurality of cementitious blocks each further including a second face panel in spaced coextending relationship with the other one of the longitudinal surfaces of said central body portion to define a second coextensive passage between the other longitudinal surface of said central body portion and said second face panel; and (b) a second polyurethane foam panel cast and cured in situ within the second aligned coextensive passages formed by said plurality of said cementitious blocks to provide a second one piece uninterrupted integral thermally insulative barrier within said modular array and which is coextensive therewith.

4. A thermally insulative cementitious block module as claimed in claims 1 or 2 wherein said plurality of said cementitious blocks are fixedly attached to each other by an adhesive mortar which is interposed between the abutting surfaces thereof.

5. A thermally insulative cementitious block module as claimed in claims 1 or 2 and further comprising at least one reinforcing rod embedded in said polyurethane foam panel.

6. A thermally insulative cementitious block module as claimed in claims 1 or 2 and further comprising a surface bonding cement coating on at least one surface of said modular array.

7. A thermally insulative cementitious block module as claimed in claims 1 or 2 wherein said plurality of cementitious blocks are arranged in an end to end relationship.

8. A thermally insulative cementitious block module as claimed in claims 1 or 2 wherein said plurality of cementitious blocks are arranged in a vertically stacked relationship.

9. A thermally insulative cementitious block module as claimed in claims 1 or 2 wherein said plurality of cementitious blocks are arranged in an end to end relationship and in a vertically stacked relationship.

10. A method of making a cementitious block module having at least one thermally insulative one piece panel formed integrally therein so as to be uninterrupted and coextensive therewith, said method comprising the steps of:

(a) casting and curing a plurality of cementitious blocks each having a central body portion with an opposed pair of longitudinal surfaces and a face panel spaced from and coextensive with one of the longitudinal surfaces thereof to define a coextensive passage between said central body portion and said face panel, said central body portion and said face panel interconnected by at least one thin wall web;

(b) placing said plurality of cementitious blocks in an open top holding fixture so that said blocks are arranged in a modular array with the coextensive passages defined by said blocks being in alignment;

(c) placing the chemical constituents which form polyurethane foam in the aligned passages defined by said plurality of cementitious blocks; and (d) curing the chemical constituents of step (c) in situ within the aligned passages defined by said plurality of cementitious blocks to fill those passages with polyurethane foam to fusingly bond said plurality of cementitious blocks into the modular array and provide a one piece coextensive uninterrupted thermally insulative barrier therein.

11. A method of making a cementitious block module as claimed in claim 10 and including the additional step of removing the webs which interconnect the central body portions and the face panels of said plurality of cementitious blocks subsequent to step (b) and prior to step (c).

12. A method of making a cementitious block module as claimed in claim 10 and including the additional steps of:

(a) removing a portion of the webs which interconnect the central body portions and the face panels of said plurality of cementitious blocks subsequent to step (b) to sever the connection thereof and provide the remaining portions of said webs with downwardly sloping edges; and (b) placing at least one reinforcing rod in the aligned passages defined by said plurality of cementitious blocks prior to step (c) so that said reinforcing rod is supported on the sloping edges of the remaining portions of said webs.

13. A method of making a cementitious block module as claimed in claim 10 wherein said plurality of cementitious blocks are arranged in said holding fixture so that each of said blocks is in abutting engagement with at least one of the other of said plurality of cementitious blocks.

14. A method of making a cementitious block module as claimed in claim 13 and including the further step of applying an adhesive mortar on the abutting surfaces of said plurality of cementitious blocks prior to step (b).

15. A method of making a cementitious block module as claimed in claim 10 and including the further step of trimming the excess polyurethane foam which protrudes from the top of the aligned passage defined by said plurality of cementitious blocks subsequent to step (d).

16. A method of making a cementitious block module as claimed in claim 10 and including the further step of applying a surface bonding cement coating on at least one of the surfaces of the modular array of said plurality of cementitious blocks subsequent to step (d).

* * * * *